United States Patent [19]

Jurgens

[11] Patent Number: 4,905,778

[45] Date of Patent: Mar. 6, 1990

[54] DEVICE FOR PRODUCING PRESSURE PULSES IN AN OIL WELL FLUID MEDIUM

[75] Inventor: Rainer Jurgens, Celle, Fed. Rep. of Germany

[73] Assignee: Eastman Christensen Company, Salt Lake City, Utah

[21] Appl. No.: 191,407

[22] Filed: May 9, 1988

[30] Foreign Application Priority Data

Sep. 9, 1987 [DE] Fed. Rep. of Germany ..... 3715512

[51] Int. Cl.[4] ..... G01V 1/40; E21B 21/10; E21B 47/12

[52] U.S. Cl. ..... 175/232; 166/320; 367/83; 367/85

[58] Field of Search ..... 166/316, 319, 320; 175/232, 40, 25, 50; 367/84, 85, 81–83

[56] References Cited

U.S. PATENT DOCUMENTS

| | | | |
|---|---|---|---|
| Re. 29,734 | 8/1978 | Manning | 367/83 |
| 3,764,969 | 10/1973 | Cubberly, Jr. | 175/232 X |
| 3,764,970 | 10/1973 | Manning | 175/232 X |
| 3,958,217 | 5/1976 | Spinnler | 367/83 |
| 4,641,289 | 2/1987 | Jurgens | 367/85 |

FOREIGN PATENT DOCUMENTS

| | | | |
|---|---|---|---|
| 2029873 | 3/1980 | United Kingdom | 175/232 |

*Primary Examiner*—Bruce M. Kisliuk
*Attorney, Agent, or Firm*—Arnold, White & Durkee

[57] ABSTRACT

An apparatus for producing pressure pulses in an oil well fluid medium is established which includes a main valve member moveable relative to a supporting member by a pressure gradient between two flow channels. The main valve body is longitudinally moveable relative to the supporting body, and a gap is provided between the two bodies. The gap is opened for fluid flow which prevents the development of dead water zones and the buildup of sedimentary deposits to prevent restriction of movement between the two bodies. The gap includes one or more throttle zones to assist in maintaining the necessary gradient between the two flow channels.

9 Claims, 1 Drawing Sheet

DEVICE FOR PRODUCING PRESSURE PULSES IN AN OIL WELL FLUID MEDIUM

BACKGROUND OF THE INVENTION

This invention concerns a device for producing pressure pulses in an oil well fluid medium flowing downward through borehole casing in a design according to the definition of species of claim 1.

In equipment such as that illustrated in U.S. Pat. No. 3,958,217, contact gaskets, especially O-ring gaskets are provided in the overlap area between the main valve body and the supporting body in order to completely suppress leakage of oil well fluid between the main valve body and the supporting body. At the same time this also assures that there will be no pressure drop in the inside flow channel when the auxiliary valve is actuated to induce a pressure pulse generating movement of the main valve body and thus the outlet opening of the inside flow channel is sealed.

However, the contact gaskets cause the development of dead water zones in the overlap area where solid particles entrained by the oil well fluid are deposited. Such sedimentation can cause movement resistance on the main valve body after only a short period of time which ultimately results in complete blockage. With an increase in the movement resistance, displacement can occur in the form and height of the pressure pulses caused by the movements of the main valve body in the oil well fluid medium with the result that the signals are no longer recognizable or they cannot be recognized correctly.

SUMMARY OF THE INVENTION

This invention is based on the problem of creating a device of the type defined initially which effectively prevents the development of movement resistance on the main valve body as the result of a build-up of sediment. This invention solves this problem starting with a device according to the definition of species of claim 1 with the features of the characterizing part of this claim. With regard to additional versions, reference is made to claim 2 to 10.

Leaving a gap between the main valve body and the supporting body so the oil well fluid medium can flow through it completely prevents the development of dead water zones and thus the build-up of sedimentary deposits, so even after a long operating time, the operating conditions are still determined exclusively by the hydraulic pressure conditions. The design of the gap in the overlap area as a narrow throttle zone nevertheless assures that the pressure conditions that develop in the inside flow channel can be definitely predetermined while at the same time assuring that the angle of a theoretically conceivable tilting movement of the main valve body relative to the supporting body will be small and will counteract pinching and binding phenomena.

At the same time, however, this design assures that the gap width will exceed the particle size of the solid particles entrained in the oil well fluid medium even in the area of the throttle zone of the gap between the outside valve body and the supporting body so that lodging of solids is prevented.

The gap in the overlap area preferably forms two throttle zones spaced some distance apart one after the other, so the gap has a much larger gap width in the areas adjacent to the throttle zones in the overlap area. This reduces the danger of blockage due to tilting movements and also assures that the throttle zone will always have the same total length regardless of the position of the main valve body relative to the supporting body. This also achieves the result that the throttling effect on the oil well fluid medium in the throttle zone is always the same.

The gap in the area of the throttle zone is preferably limited by a surface forming the surface of an armor plating on at least one side, which increases the lifetime of the parts exposed to the abrasive action of the oil well fluid medium and delays the widening of the gap due to wear in the area of the throttle zone.

BRIEF DESCRIPTION OF THE DRAWINGS

Additional details are derived from the following description in combination with the figure which illustrates schematically different versions of the object of this invention. The figures show the following.

DETAILED DESCRIPTION OF THE INVENTION

Figure 1:
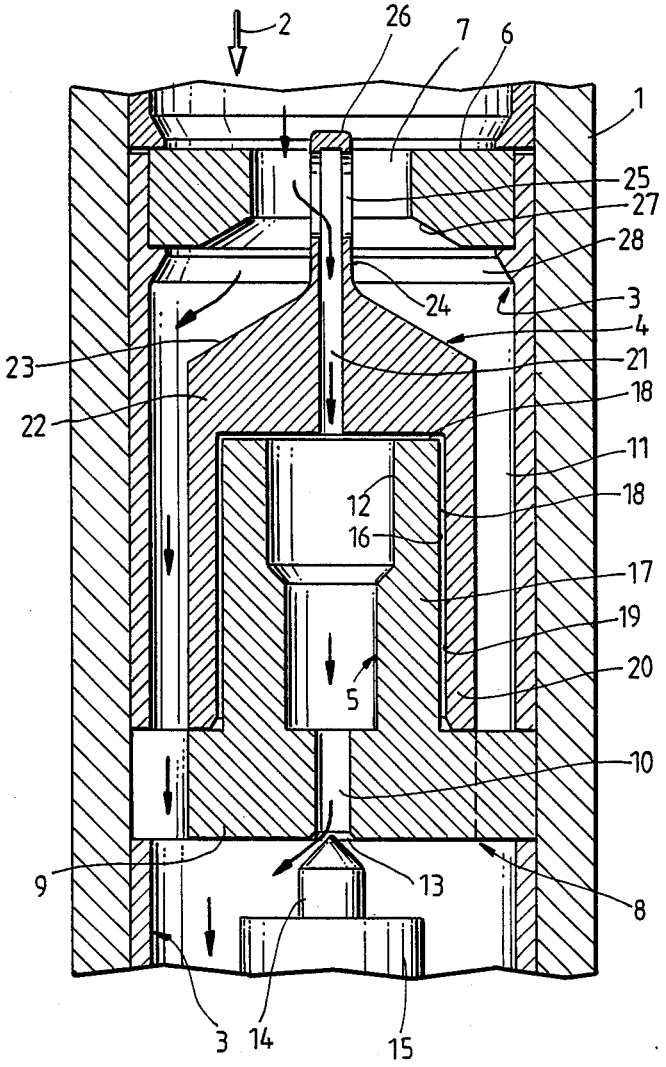
FIG. 1 shows a cutaway longitudinal section through an oil well casing and a device positioned in it to produce pressure surges according to this invention.

The apparatus for producing pressure pulses in an oil well fluid medium flowing through an oil well casing 1 downward in the direction of arrow 2 (the medium flows up again in the annular space between the well of the casing and the outside wall after coming out one end of the casing through a drill bit at the end of the casing) consists essentially of a valve located in borehole casing and consisting of an outside part 3, a main valve body 4 and a supporting body 5.

The essentially tubular outside part 3 supported in a stationary position in oil well casing 1 includes an upper ring part 6 with a central axial passage 7 whose cross section is essentially smaller than the cross section in oil well casing 1 above the valve. Furthermore, outside part 3 supports foot part 8 of supporting part 5 in a stationary position in its lower area which is designed so it is closed except for an axial passage orifice 10 in central area 9. However, there remain passages for the oil well fluid medium distributed over the periphery between the central area and the internal side of outside part 3 so the medium can flow down through the annular outside flow channel 11 between outside part 3 and main valve body 4.

The foot part 8 forms an integral (or separate) component of the supporting body 5, most of which is designed so it is essentially tubular and has a central passage 12. This passage continues into passage 10 which has a valve seat 13 at its lower end. This valve seat also forms the outlet opening of an inside flow channel which is bordered by axial passages 12, 10 in its lower area.

An auxiliary valve body 14 which can move upward out of its open position as shown in this figure into a closed position where it closes outlet opening 13 is actuated by means of a drive 15, e.g., an electromagnet, and is provided for the valve seat or the outlet opening 13.

Supporting body 5 is designed so it is cylindrical in the area of the outside surface 16 of the main part 17 and borders an annular gap 18 with this cylindrical outside surface 16, and this annular gap is in turn bordered on the outside by a cylindrical surface 19 of a tubular shouldered part 20 of main valve body 4. The opposite faces 16, 19 for the entire length in the starting position of main valve body 4 shown in FIG. 1 define an overlap area between main valve body 4 and supporting body 5 whose length is reduced as soon as main valve body 4 executes an upward movement in the direction of ring part 6. Main valve body 4 has an upper end part 22 that is closed except for a passage 21 and has a conical surface 23 which develops into a tubular projection 24 in the central area. In the starting position of the main valve body 4, this projection presents side openings 25 at the level of passage 7 in ring part 6 that communicate with passage 21. These side openings 25 form the inlet opening for the inside flow channel which is surrounded by the passage 21 in the upper area and is then continued by passages 12 and 10. Projection 24 is sealed at end 26 and in this way forms a type of Pitot tube.

In the area between an underside 27 of ring part 6 which is likewise tapered in a conical shape and the conical top side 23 of main valve body 4, the outside flow channel 11 forms a throttle zone 28 whose flow cross section depends on the position of main valve body 4.

Gap 18 between main valve body 4 and supporting body 5 is freely passable for flow of the oil well fluid medium, and oil well fluid medium flows through it in all positions of the main valve body 4 relative to supporting body 5 due to the pressure gradient between the oil well fluid medium in the passage 12 and in the outside flow channel 11.

In the overlap area defined by faces 16, 19, gap 18 forms a narrow throttle zone due to the fact that the width of gap 18 in the area of the narrow throttle zone 29 is such that it is less than 1/100 of the diameter of the annular gap 18 and is preferably in the range between 0.05 and 0.5 mm, preferably 0.15 mm.

Figure 4:
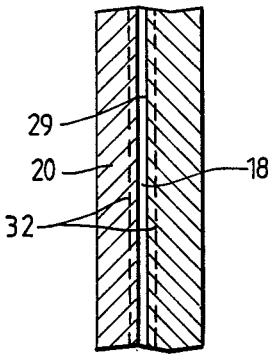

Gap 18 has a uniform gap width over its length in the area of the narrow throttle zone 29. The throttle zone may extend essentially over the entire length of the overlap area between the main valve body 4 and supporting body 5 as illustrated in FIG. 4, where the narrow throttle zone of the gap is labeled as 29.

Figure 2:
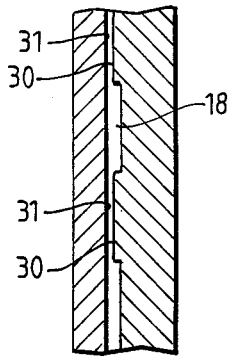
FIGS. 2 to 4 snow cutaway schematic partial sectional views through the overlap region between the main valve body and the supporting body.
Figure 3:
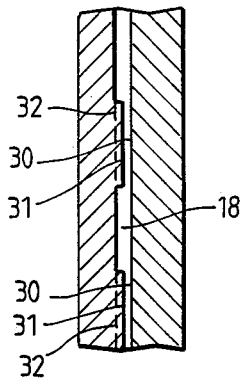

Instead of this, gap 18 may also form two or more throttle zones 30 spaced a distance apart one after the other in the overlap area as shown schematically in FIGS. 2 and 3. Then gap 18 has a much larger gap width in the areas adjacent to narrow throttle zones 30 as also illustrated in FIGS. 2 and 3.

Instead of the possibility of considering parts 4 and 5 as wear parts and replacing them with new parts when wear occurs due to the abrasive action of the oil well fluid medium in the area of gap 18, there is also the possibility of designing gap 18 so it borders a surface that forms an armored reinforcement 31 on one or both sides in the area of throttle zones 29, 30 as shown for throttle zones 30 in FIGS. 2 and 3.

In a modification of the example shown here, any other type of valve may also be used as long as it is provided with a main valve body positioned coaxially in an outside part with a supporting body as a supporting and guide element and the two latter elements must border an overlap area with a cylindrical gap.

What is claimed:

1. An apparatus for producing pressure pulses and in oil well fluid medium flowing in a drill string, comprising:

a valve assembly coupled in said drill string, said valve assembly comprising, an exterior member, an axially movable generally tubular valve member located generally coaxially within said exterior member, said generally tubular valve member and said exterior member cooperatively defining an annular flow channel, said flow channel defining, at least in part, a first throttle zone having a flow cross-section which varies as a function of the position of said generally tubular valve member within said exterior member, said generally tubular valve member surrounding an inside flow channel whose inlet orifice is located proximate a closed end part of said tubular valve member, a supporting member in said exterior member, said supporting member generally coaxial with said generally tubular valve member and at least partially coextensive with said valve member, and defining a cylindrical gap with said tubular valve member where said members overlap, wherein said gap is freely passable for the flow of said oil well fluid medium through it from said inside flow channel to said annular flow channel and wherein said gap forms a second throttle zone in said overlap area, said supporting member also surrounding said inside flow channel, and defining an outlet orifice for said inside flow channel in the direction of flow; and an auxiliary valve assembly adapted to selectively open and close said outlet orifice of said inside flow channel.

2. The apparatus of claim 1, wherein the width of said gap in the area of said second throttle zone is less than one-hundredth of the diameter across the exterior of said cylindrical gap.

3. The apparatus of claim 1, wherein said gap has a width within the range of 0.05–0.5 millimeters.

4. The apparatus of claims 1–3, wherein said gap in the area of said second throttle zone has a width which is uniform over essentially its entire length.

5. The apparatus of claim 1, wherein said second throttle zone extends essentially over the entire length of said overlap area.

6. The apparatus of claim 1, wherein said gap further forms a third throttle zone.

7. The apparatus of claim 1, wherein said throttle zone is bounded on at least one side by a facing that forms the surface of an armor plating.

8. The apparatus of claim 7, wherein said armor plating is applied in the form of a layer coating.

9. The apparatus of claim 7, wherein said armor plating comprises a layer of tungsten carbide.

* * * * *